US008253044B2

(12) United States Patent
Beatty, Jr. et al.

(10) Patent No.: US 8,253,044 B2
(45) Date of Patent: Aug. 28, 2012

(54) CONFIGURABLE ELECTRICAL SWITCHING APPARATUS INCLUDING A PLURALITY OF SEPARABLE CONTACTS AND A PLURALITY OF FIELD-CONFIGURABLE JUMPERS TO PROVIDE A NUMBER OF POLES

(75) Inventors: William E. Beatty, Jr., Beaver Brighton, PA (US); Xin Zhou, Franklin Park, PA (US)

(73) Assignee: Eaton Corporation, Cleveland, OH (US)

( * ) Notice: Subject to any disclaimer, the term of this patent is extended or adjusted under 35 U.S.C. 154(b) by 160 days.

(21) Appl. No.: 12/958,566

(22) Filed: Dec. 2, 2010

(65) Prior Publication Data

US 2012/0138442 A1 Jun. 7, 2012

(51) Int. Cl.
*H01H 1/58* (2006.01)

(52) U.S. Cl. ..... 200/1 R; 200/43.01; 200/51 R

(58) Field of Classification Search ..... 200/1 R, 200/43.01–43.05, 17 R, 51.09, 51 R, 51.02, 200/51.04, 51.03, 51.05, 51.06
See application file for complete search history.

(56) References Cited

U.S. PATENT DOCUMENTS

| | | | | |
|---|---|---|---|---|
| 4,222,088 | A * | 9/1980 | Burton | 361/172 |
| 4,947,068 | A * | 8/1990 | Howard et al. | 310/71 |
| 5,504,689 | A * | 4/1996 | Fiebrich et al. | 702/122 |
| 5,726,507 | A * | 3/1998 | Tipton | 307/147 |
| 5,899,764 | A * | 5/1999 | Harting et al. | 439/188 |
| 6,614,334 | B1 | 9/2003 | Gibson et al. | |
| 2005/0073789 | A1 * | 4/2005 | Tanis | 361/100 |
| 2010/0310402 | A1 * | 12/2010 | Sun | 418/201.1 |

* cited by examiner

*Primary Examiner* — Gary F. Paumen
(74) *Attorney, Agent, or Firm* — Eckert Seamans Cherin & Mellott, LLC; Kirk D. Houser

(57) ABSTRACT

An electrical switching apparatus includes at least one pole; a plurality of first terminals; a plurality of second terminals; a plurality of pairs of separable contacts; and a plurality of field-configurable jumpers. Each of the plurality of field-configurable jumpers electrically connects two of the pairs of separable contacts in series. Each of the plurality of field-configurable jumpers are electrically connected to: (a) two of the first terminals, (b) two of the first terminals or (c) two of the second terminals; or one of the first terminals and one of the second terminals.

21 Claims, 6 Drawing Sheets

CONFIGURABLE ELECTRICAL SWITCHING APPARATUS INCLUDING A PLURALITY OF SEPARABLE CONTACTS AND A PLURALITY OF FIELD-CONFIGURABLE JUMPERS TO PROVIDE A NUMBER OF POLES

BACKGROUND

1. Field

The disclosed concept pertains generally to electrical switching apparatus and, more particularly, to circuit breakers including a plurality of separable contacts.

2. Background Information

U.S. Pat. No. 6,614,334 discloses a series arrangement of two circuit breaker mechanisms. The interruption performance of the circuit breaker is determined by the "current limitation of series arcs," which provides two arcs in series, thereby having twice the resistance of a single arc.

It is known to connect multiple poles of circuit breakers in series to provide a high voltage for a low voltage switching and interruption device (e.g., without limitation, 750 VDC; 1000 VDC; 1500 VAC).

Circuit breakers are typically available in one-, two-, three- and four-pole construction, although larger counts of poles are possible.

For a 1000 VDC application, typically multiple circuit breakers are tied together. Most known existing six-pole or eight-pole air circuit breakers are designed such that the poles are electrically connected internally in breaker structures in a predetermined manner. This limits the flexibility of wiring the six-pole or eight-pole circuit breakers in switchgear and switchboards.

There is room for improvement in electrical switching apparatus, such as circuit breakers including a plurality of separable contacts.

SUMMARY

These needs and others are met by embodiments of the disclosed concept, in which an electrical switching apparatus comprises: at least one pole; a plurality of first terminals; a plurality of second terminals; a plurality of pairs of separable contacts; and a plurality of field-configurable jumpers, each of the plurality of field-configurable jumpers electrically connecting two of the pairs of separable contacts in series, each of the plurality of field-configurable jumpers being electrically connected to: (a) two of the first terminals, (b) two of the first terminals or two of the second terminals; or (c) one of the first terminals and one of the second terminals.

N may be an integer count of the at least one pole; the N of the plurality of first terminals may be input terminals; the N of the plurality of second terminals may be output terminals; two of the pairs of separable contacts may be electrically connected in series for each of the at least one pole; and each of the N of the plurality of field-configurable jumpers may be electrically connected between one of the plurality of first terminals that may be not one of the input terminals and one of the plurality of second terminals that may be not one of the output terminals.

The at least one pole may be the integer count N of a plurality of poles structured to power an AC load having the integer count N of a plurality of phases.

Each of the plurality of field-configurable jumpers may be electrically connected to the one of the first terminals and the one of the second terminals.

N may be an integer count of the at least one pole; the N of the plurality of second terminals may be input terminals; the N of the plurality of second terminals may be output terminals; two of the pairs of separable contacts may be electrically connected in series for each of the at least one pole; and each of the N of the plurality of field-configurable jumpers may be electrically connected between two of the plurality of first terminals.

Each of the plurality of field-configurable jumpers may be electrically connected to the two of the first terminals.

Two of the plurality of first terminals may be input terminals; two of the plurality of second terminals may be output terminals; N may be an integer count of the plurality of field-configurable jumpers; two of the pairs of separable contacts may be electrically connected to the output terminals; half of the N field-configurable jumpers may electrically connect half of the pairs of separable contacts in series between one of the input terminals and one of the output terminals; the other half of the N field-configurable jumpers may electrically connect the other half of the pairs of separable contacts in series between the other one of the input terminals and the other one of the output terminals; and the output terminals may be structured for electrical connection to a load.

One of the plurality of first terminals may be an input terminal; another one of the plurality of first terminals may be an output terminal; N may be an integer count of the plurality of field-configurable jumpers; one of the pairs of separable contacts may be electrically connected to the input terminal; another one of the pairs of separable contacts may be electrically connected to the output terminal; the N of the plurality of field-configurable jumpers may electrically connect the pairs of separable contacts in series between the input terminal and the output terminal; and the input terminal and the output terminal may be structured to receive the series combination of a load and a power source.

Each of the plurality of field-configurable jumpers may be electrically connected to the two of the first terminals or two of the second terminals.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the term "fastener" shall mean screws, bolts and the combinations of bolts and nuts (e.g., without limitation, lock nuts) and bolts, washers and nuts.

As employed herein, the term "electrical conductor" shall mean a wire (e.g., solid; stranded; insulated; non-insulated), a copper conductor, an aluminum conductor, a suitable metal conductor, or other suitable material or object that permits an electric current to flow easily.

As employed herein, the term "low voltage" shall mean a voltage less than or equal to about 1000 VAC or about 750 VDC.

As employed herein, the term "high voltage for a low voltage device" shall mean greater than a "low voltage" and up to approximately 1500 volts, although this may be slightly higher depending upon the application but no more than 2000 volts.

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

The disclosed concept is described in association with six-pole circuit breakers (i.e., having six pairs of separable contacts), although the disclosed concept is applicable to a wide range of electrical switching apparatus having eight poles (i.e., having eight pairs of separable contacts) or any other suitable plurality of poles.

An example six-pole air circuit breaker as disclosed herein can include terminals accessible for every pole for both high voltage (for a low voltage device) AC and DC applications. With accessibility to terminals of each pole, the six-pole circuit breaker can be wired or otherwise configured in different ways. For example, with six poles electrically connected in series, it can be used for applications with systems voltages over 600 VDC. With two poles tied in series, for instance, it can be used for three-phase applications over 600 VAC.

In a "potentially grounded load", the system ground could be either at the power end or at the load (at the site).

The disclosed concept can be employed, for example and without limitation, for "green" systems (e.g., wind and solar segments).

Figure 1:
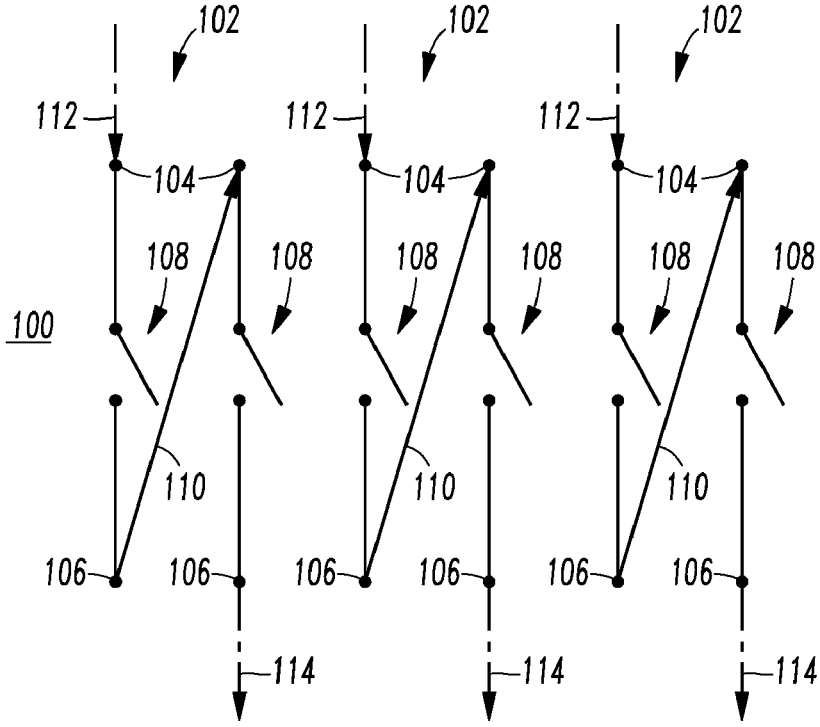
FIGS. 1-4 are block diagrams in schematic form of terminals, separable contacts and jumpers of electrical switching apparatus in accordance with embodiments of the disclosed concept.
Figure 2:
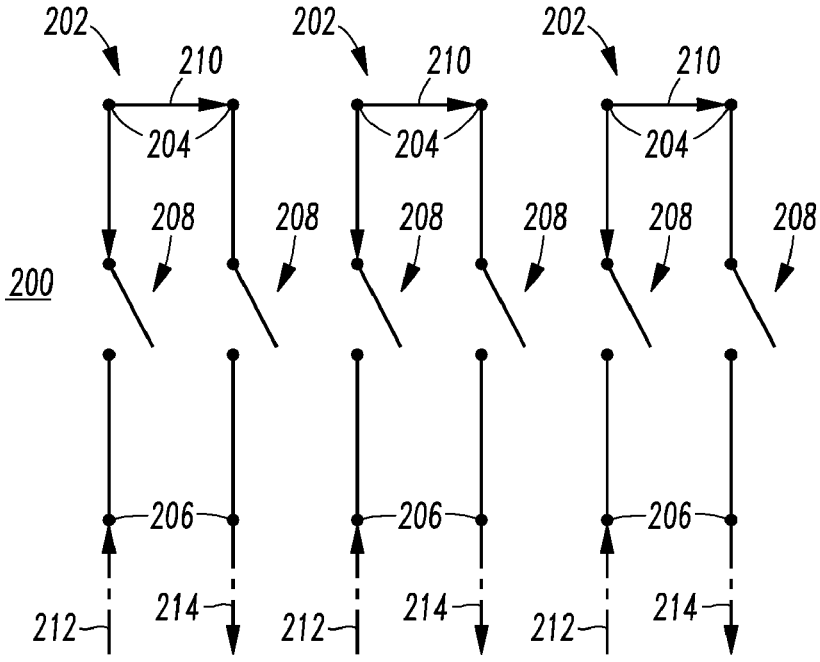
Figure 3:
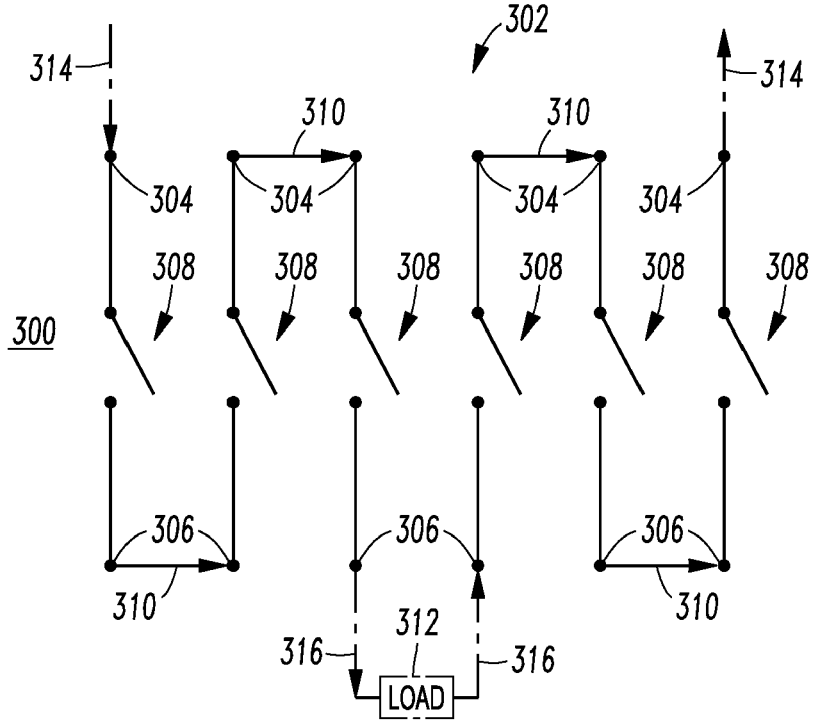
Figure 4:
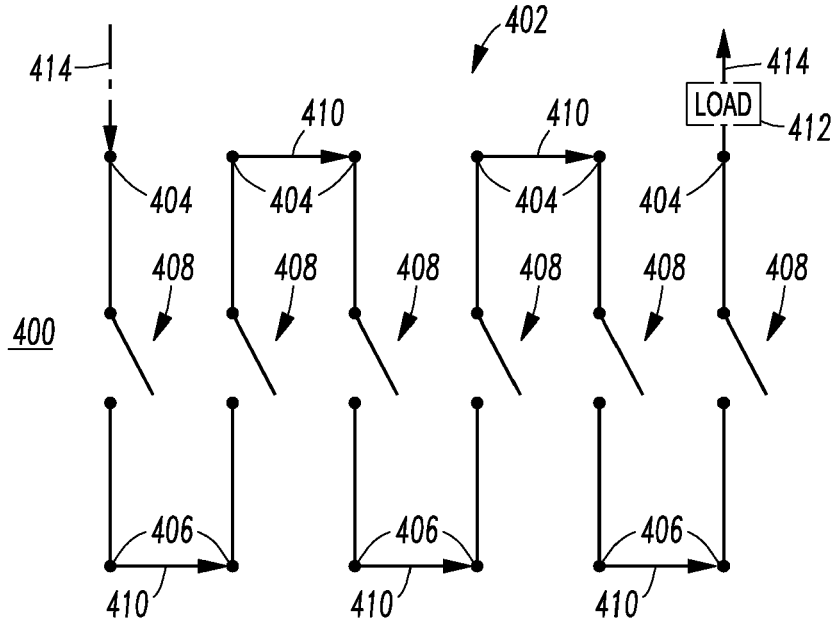

Referring to FIGS. 1-4, configured electrical switching apparatus, such as circuit breakers 100,200,300,400, include at least one pole. For example, three configured poles 102,202 are shown in respective FIGS. 1 and 2, and one configured pole 302,402 is shown in FIGS. 3 and 4, respectively. The circuit breakers 100,200,300,400 further include a plurality of first terminals 104,204,304,404, a plurality of second terminals 106,206,306,406, a plurality of pairs of separable contacts 108,208,308,408, and a plurality of field-configurable jumpers 110,210,310,410, respectively. Each of the plurality of field-configurable jumpers 110,210,310,410 electrically connects two of the respective pairs of separable contacts 108,208,308,408 in series. Each of the plurality of field-configurable jumpers 110,210,310,410 is electrically connected to: (a) two of the first terminals 204 as shown with the jumpers 210 in FIG. 2, (b) two of the first terminals 304,404 or two of the second terminals 306,406 as shown with the jumpers 310,410 in FIGS. 3 and 4, respectively, or (c) one of the first terminals 104 and one of the second terminals 106 as shown with the jumpers 110 in FIG. 1.

It will be appreciated that the example circuit breakers 100,200,300,400 can be the same or similar devices except for the specific example configurations of the various field-configurable jumpers 110,210,310,410.

EXAMPLE 1

For example, with reference to FIG. 1, N=3 is a non-limiting example integer count of the three example poles 102. N of the plurality of first terminals 104 are input terminals. N of the plurality of second terminals 106 are output terminals. Two of the pairs of separable contacts 108 are electrically connected in series for each of the three example poles 102. Each of N of the plurality of field-configurable jumpers 110 is electrically connected between one of the plurality of first terminals 104 that is not one of the input terminals and one of the plurality of second terminals 106 that is not one of the output terminals. For example, the circuit breaker 100, as configured in FIG. 1, can input three input phases 112 (as shown in phantom line drawing) (e.g., without limitation, phases A, B and C from an example three-phase power source (not shown)) and output three output phases 114 (as shown in phantom line drawing) (e.g., without limitation, phases A, B and C to an example three-phase load (not shown)).

EXAMPLE 2

The three example poles 102 are structured to power an AC load (not shown) having three example phases. It will be appreciated, however, that any suitable number of phases can be employed for either AC or DC loads.

EXAMPLE 3

For example, with reference to FIG. 2, N=3 is an example non-limiting integer count of the three example poles 202. N of the plurality of second terminals 206 are input terminals. N of the plurality of second terminals 206 are output terminals. Two of the pairs of separable contacts 208 are electrically connected in series for each of the three example poles 202. Each of N of the field-configurable jumpers 210 is electrically connected between two of the plurality of first terminals 204. For example, the circuit breaker 200, as configured in FIG. 2, can input three input phases 212 (as shown in phantom line drawing) (from an example three-phase power source (not shown)) and output three output phases 214 (as shown in phantom line drawing) (to an example three-phase load (not shown)).

EXAMPLE 4

The three example poles 202 are structured to power an AC load (not shown) having three example phases. It will be appreciated, however, that any suitable number of phases can be employed for either AC or DC loads.

EXAMPLE 5

For example, with reference to FIG. 3, two of the plurality of first terminals 304 are input terminals, two of the plurality of second terminals 306 are output terminals for a load 312 (shown in phantom line drawing), N=4 is an example integer count of the plurality of field-configurable jumpers 310, two of the pairs of separable contacts 308 are electrically connected to the output terminals for the load 312, half (N/2=2) of the N field-configurable jumpers 310 electrically connect half of the pairs of separable contacts 308 in series between one of the input terminals 304 and one of the output terminals for the load 312, and the other half of the N field-configurable jumpers 310 electrically connect the other half of the pairs of separable contacts 308 in series between the other one of the input terminals 304 and the other one of the output terminals for the load 312.

EXAMPLE 6

The example load 312 is a DC load, and the example pole 302 is structured to power the DC load. For example, the circuit breaker 300, as configured in FIG. 3, can input one DC input 314 (as shown in phantom line drawing) (from an example DC power source (not shown)) and output one DC output 316 (as shown in phantom line drawing) to the example DC load 312.

EXAMPLE 7

For example, with reference to FIG. 4, one of the plurality of first terminals 404 is an input terminal, another one of the plurality of first terminals 404 is an output terminal, N=5 is an integer count of the plurality of field-configurable jumpers 410, one of the pairs of separable contacts 408 is electrically connected to the input terminal, another one of the pairs of separable contacts 408 is electrically connected to the output terminal, N of the plurality of field-configurable jumpers 410 electrically connect the pairs of separable contacts 408 in series between the input terminal and the output terminal, and the input terminal and the output terminal are structured to receive the series combination of a load 412 and a power source 414.

EXAMPLE 8

The example load 412 is a DC load, and the pole 402 is structured to power the DC load. For example, the circuit breaker 400, as configured in FIG. 4, can input one DC input from the DC power source 414 (as shown in phantom line drawing) for the DC load 412.

EXAMPLE 9

FIGS. 5-8 shows the respective circuit breakers 100,200, 300,400. It will be appreciated that the separable contacts 108,208,308,408 of FIGS. 1-4, respectively, are not shown along with the corresponding circuit breaker operating mechanism (not shown) and trip unit (not shown).

Figure 5:
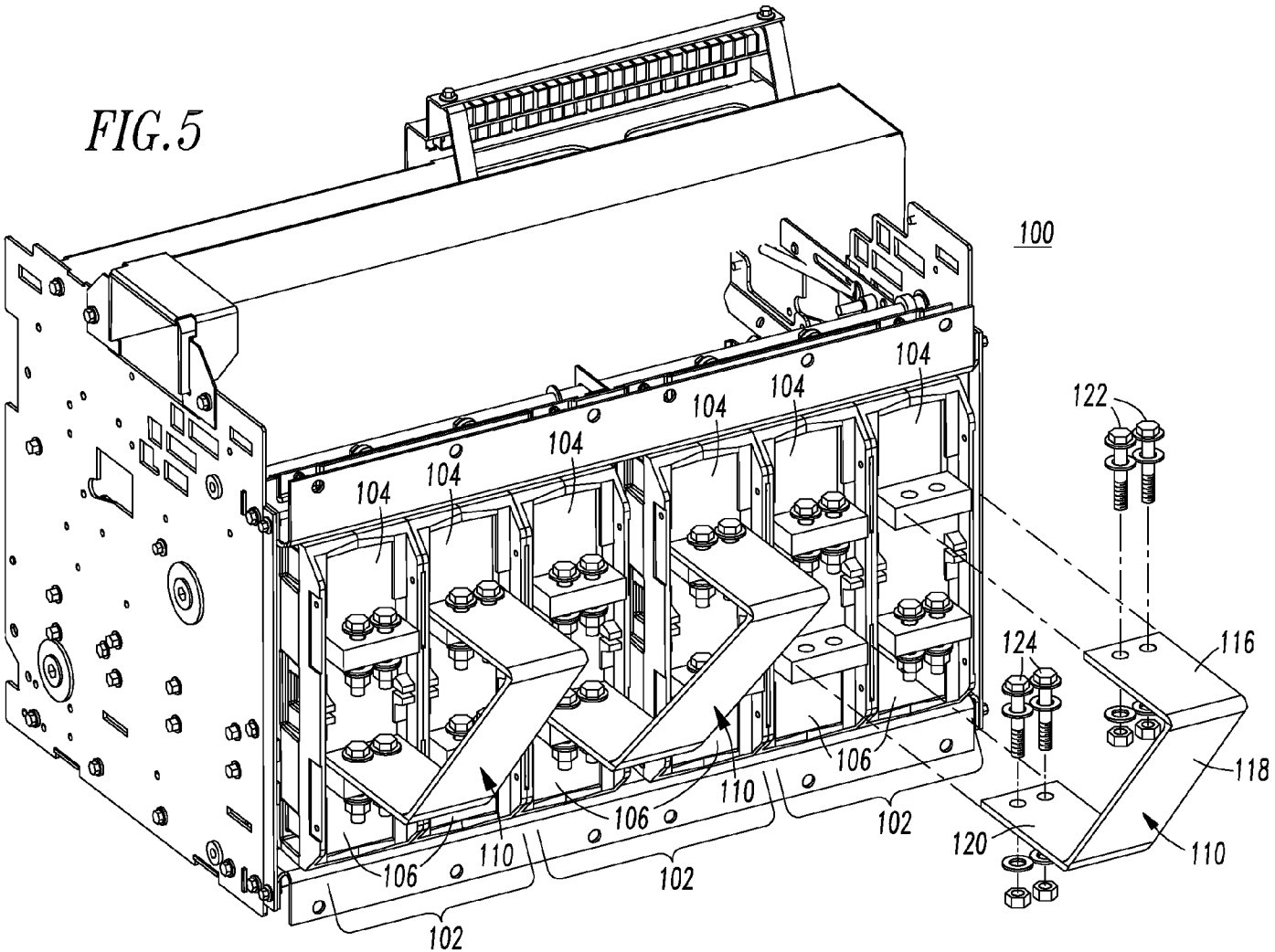
FIGS. 5-8 are isometric views of the electrical switching apparatus of FIGS. 1-4, respectively.

As shown in FIG. 5, each of the field-configurable jumpers 110 is an electrical conductor including a first planar portion 116, a second planar portion 118 and a third planar portion 120. The first planar portion 116 is parallel to the third planar portion 120. The second planar portion 118 is normal to the first planar portion 116 and to the third planar portion 120. The first planar portion 116 is electrically connected to one of the first terminals 104 by a number of fasteners 122. The third planar portion 120 is electrically connected to one of the second terminals 106 by a number of fasteners 124. The example second planar portion 118 is a non-rectangular parallelogram, in order to accommodate the width offset and the height offset between the corresponding terminals 104,106.

Figure 6:
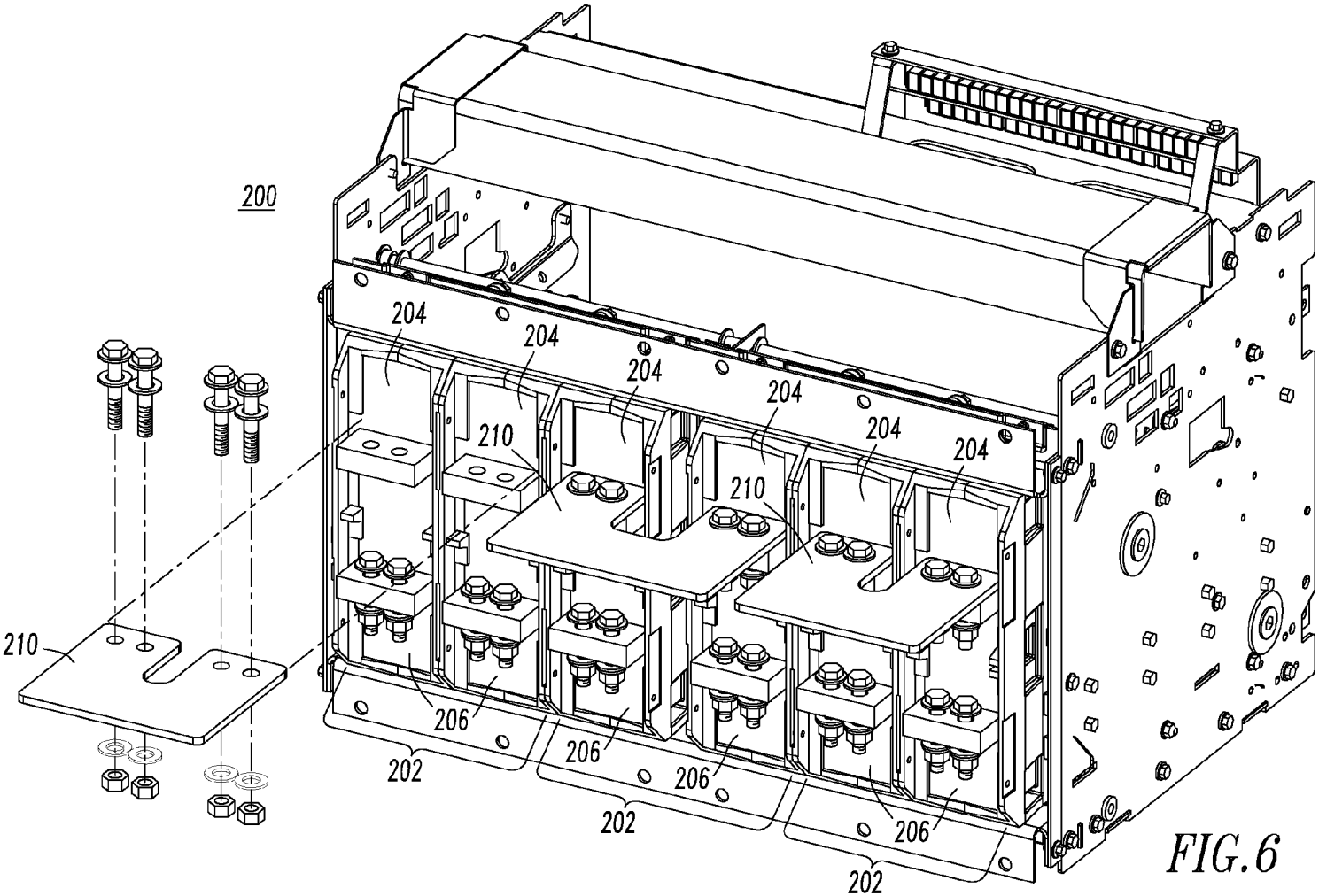
Figure 7:
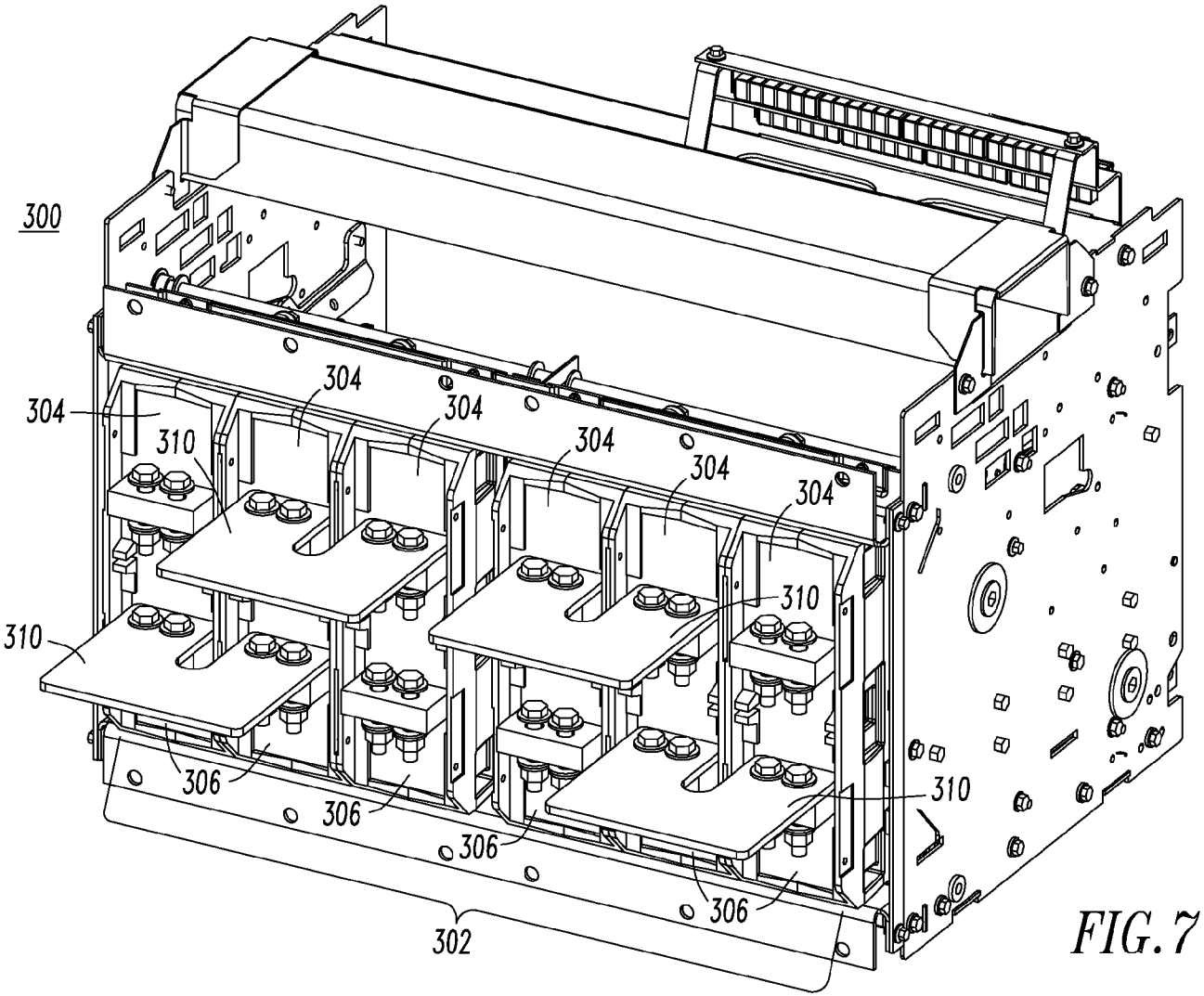
Figure 8:
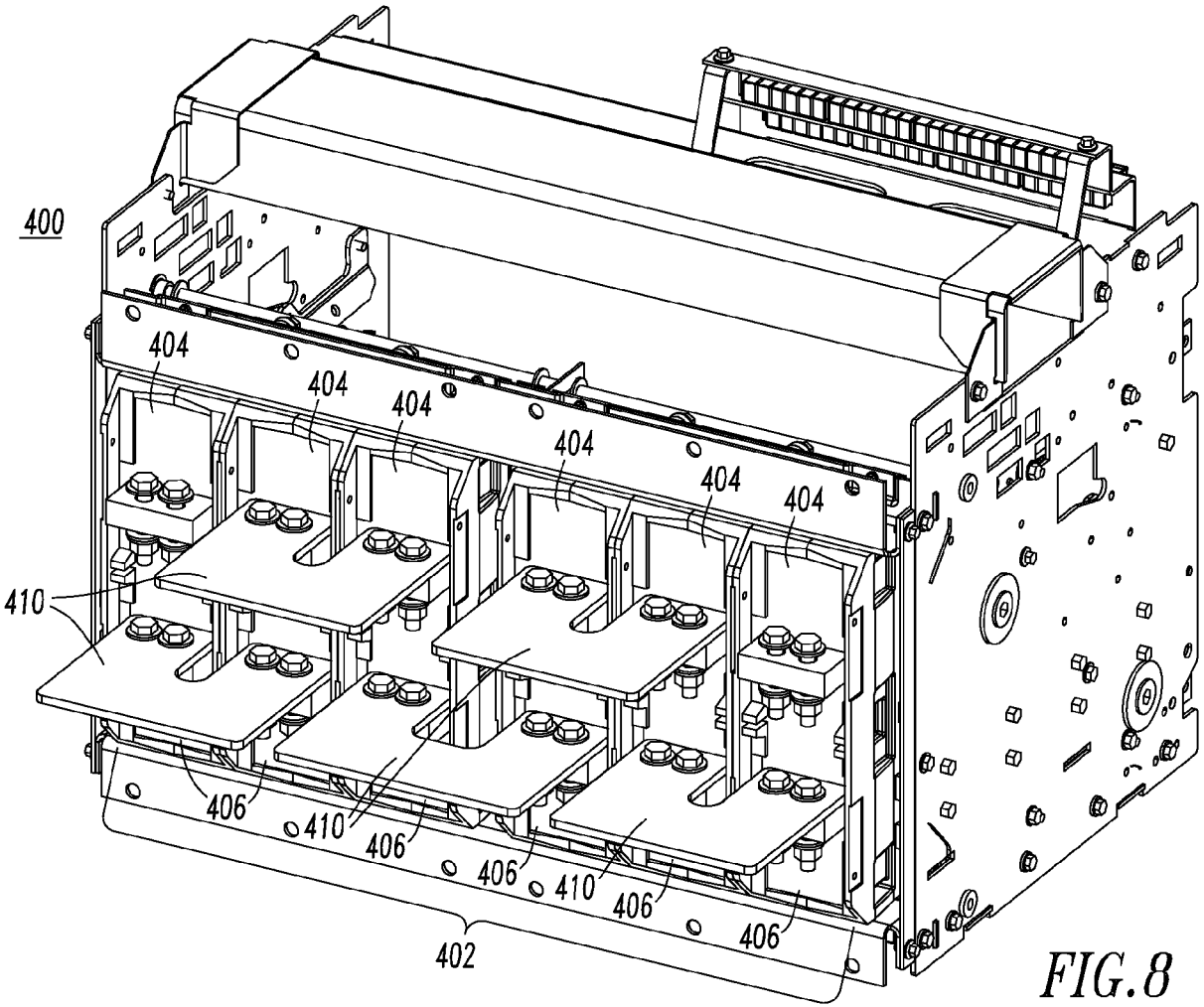

As shown in FIGS. 6-8, each of the field-configurable jumpers 210,310,410 is a planar U-shaped electrical conductor.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An electrical switching apparatus comprising:

at least one pole;

a plurality of first terminals;

a plurality of second terminals;

a plurality of pairs of separable contacts; and a plurality of field-configurable jumpers, each of said plurality of field-configurable jumpers electrically connecting two of said pairs of separable contacts in series, each of said plurality of field-configurable jumpers being electrically connected to: (a) two of said first terminals, (b) two of said first terminals or two of said second terminals; or (c) one of said first terminals and one of said second terminals.

2. The electrical switching apparatus of claim 1 wherein N is an integer count of said at least one pole; wherein said N of said plurality of first terminals are input terminals; wherein said N of said plurality of second terminals are output terminals; wherein two of said pairs of separable contacts are electrically connected in series for each of said at least one pole; and wherein each of said N of said plurality of field-configurable jumpers is electrically connected between one of said plurality of first terminals that is not one of said input terminals and one of said plurality of second terminals that is not one of said output terminals.

3. The electrical switching apparatus of claim 2 wherein said at least one pole is the integer count N of a plurality of poles structured to power an AC load having the integer count N of a plurality of phases.

4. The electrical switching apparatus of claim 1 wherein N is an integer count of said at least one pole; wherein said N of said plurality of second terminals are input terminals; wherein said N of said plurality of second terminals are output terminals; wherein two of said pairs of separable contacts are electrically connected in series for each of said at least one pole; and wherein each of said N of said plurality of field-configurable jumpers is electrically connected between two of said plurality of first terminals.

5. The electrical switching apparatus of claim 4 wherein said at least one pole is the integer count N of a plurality of poles structured to power an AC load having the integer count N of a plurality of phases.

6. The electrical switching apparatus of claim 1 wherein two of said plurality of first terminals are input terminals; wherein two of said plurality of second terminals are output terminals; wherein N is an integer count of said plurality of field-configurable jumpers; wherein two of said pairs of separable contacts are electrically connected to said output terminals; wherein half of said N field-configurable jumpers electrically connect half of said pairs of separable contacts in series between one of said input terminals and one of said output terminals; wherein the other half of said N field-configurable jumpers electrically connect the other half of said pairs of separable contacts in series between the other one of said input terminals and the other one of said output terminals; and wherein said output terminals are structured for electrical connection to a load.

7. The electrical switching apparatus of claim 6 wherein said load is a DC load; and wherein said at least one pole is one pole structured to power said DC load.

8. The electrical switching apparatus of claim 1 wherein one of said plurality of first terminals is an input terminal; wherein another one of said plurality of first terminals is an output terminal; wherein N is an integer count of said plurality of field-configurable jumpers; wherein one of said pairs of separable contacts is electrically connected to said input terminal; wherein another one of said pairs of separable contacts is electrically connected to said output terminal; wherein said N of said plurality of field-configurable jumpers electrically connect said pairs of separable contacts in series between said input terminal and said output terminal; and wherein said input terminal and said output terminal are structured to receive the series combination of a load and a power source.

9. The electrical switching apparatus of claim 8 wherein said load is a DC load; and wherein said at least one pole is one pole structured to power said DC load.

10. The electrical switching apparatus of claim 1 wherein said each of said plurality of field-configurable jumpers is electrically connected to said two of said first terminals.

11. The electrical switching apparatus of claim 10 wherein said at least one pole is a plurality of poles structured to power an AC load having a plurality of phases.

12. The electrical switching apparatus of claim 11 wherein said plurality of poles are three poles; wherein said plurality of phases are three phases; wherein said plurality of first terminals are six first terminals; wherein said plurality of second terminals are six second terminals; wherein said plurality of pairs of separable contacts are six pairs of separable contacts; and wherein said plurality of field-configurable jumpers are three field-configurable jumpers.

13. The electrical switching apparatus of claim 1 wherein said each of said plurality of field-configurable jumpers is electrically connected to said two of said first terminals or two of said second terminals.

14. The electrical switching apparatus of claim 13 wherein said at least one pole is one pole structured to power a DC load.

15. The electrical switching apparatus of claim 14 wherein said plurality of first terminals are six first terminals; wherein said plurality of second terminals are six second terminals; wherein said plurality of pairs of separable contacts are six pairs of separable contacts; and wherein said plurality of field-configurable jumpers are four field-configurable jumpers.

16. The electrical switching apparatus of claim 14 wherein said plurality of first terminals are six first terminals; wherein said plurality of second terminals are six second terminals; wherein said plurality of pairs of separable contacts are six pairs of separable contacts; and wherein said plurality of field-configurable jumpers are five field-configurable jumpers.

17. The electrical switching apparatus of claim 1 wherein said each of said plurality of field-configurable jumpers is electrically connected to said one of said first terminals and said one of said second terminals.

18. The electrical switching apparatus of claim 17 wherein said at least one pole is a plurality of poles structured to power an AC load having a plurality of phases.

19. The electrical switching apparatus of claim 18 wherein said plurality of poles are three poles; wherein said plurality of phases are three phases; wherein said plurality of first terminals are six first terminals; wherein said plurality of second terminals are six second terminals; wherein said plurality of pairs of separable contacts are six pairs of separable contacts; and wherein said plurality of field-configurable jumpers are three field-configurable jumpers.

20. The electrical switching apparatus of claim 1 wherein each of said plurality of field-configurable jumpers is a planar U-shaped electrical conductor.

21. The electrical switching apparatus of claim 1 wherein each of said plurality of field-configurable jumpers is an electrical conductor including a first planar portion, a second planar portion and a third planar portion; wherein said first planar portion is parallel to said third planar portion; wherein said second planar portion is normal to said first planar portion and said third planar portion; wherein said first planar portion is electrically connected to said one of said first terminals; wherein said third planar portion is electrically connected to said one of said second terminals; and wherein said second planar portion is a non-rectangular parallelogram.

* * * * *